US010543996B2

(12) United States Patent
Chiba

(10) Patent No.: US 10,543,996 B2
(45) Date of Patent: Jan. 28, 2020

(54) SHEET FEEDING APPARATUS AND IMAGE FORMING APPARATUS

(71) Applicant: CANON KABUSHIKI KAISHA, Tokyo (JP)

(72) Inventor: Yoshinao Chiba, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/922,994

(22) Filed: Mar. 16, 2018

(65) Prior Publication Data

US 2018/0305146 A1 Oct. 25, 2018

(30) Foreign Application Priority Data

Apr. 19, 2017 (JP) ..... 2017-083166
Jan. 18, 2018 (JP) ..... 2018-006422

(51) Int. Cl.
*B65H 3/06* (2006.01)
*B65H 1/26* (2006.01)

(52) U.S. Cl.
CPC ..... *B65H 3/0676* (2013.01); *B65H 1/266* (2013.01); *B65H 3/0638* (2013.01); *B65H 3/0684* (2013.01)

(58) Field of Classification Search
CPC ..... B65H 3/06; B65H 3/0676; B65H 1/266; B65H 3/0638; B65H 3/0684
See application file for complete search history.

(56) References Cited

U.S. PATENT DOCUMENTS 4,030,725 A * 6/1977 Fukui ..... B65H 1/04 271/164
4,775,143 A * 10/1988 Arnoldi ..... B07C 1/06 271/251
5,316,288 A * 5/1994 Fish ..... B65H 9/166 271/250
5,651,540 A * 7/1997 Watanabe ..... B65H 1/04 271/10.12
6,308,949 B1 * 10/2001 Ito ..... B65H 5/06 271/138
7,549,632 B2 * 6/2009 Kojima ..... B65H 1/12 221/287
8,651,477 B2 2/2014 Chiba
9,102,488 B2 8/2015 Chiba et al.
9,227,806 B2 1/2016 Chiba
9,254,973 B2 2/2016 Ishida et al.
9,327,926 B2 5/2016 Chiba
(Continued)

FOREIGN PATENT DOCUMENTS

JP 59-26840 * 2/1984
JP 59-190123 * 10/1984
(Continued)

*Primary Examiner* — Thomas A Morrison
(74) *Attorney, Agent, or Firm* — Venable LLP

(57) ABSTRACT

A sheet feeding apparatus includes a sheet supporting portion, a rotary feeding member configured to feed the sheet, a regulating portion configured to regulate a position of the edge portion, and a force applying portion that is provided separately from the rotary feeding member. The force applying portion contacts the sheet supported on the sheet supporting portion upstream in a conveyance direction of the rotary feeding member and applies a force to turn the sheet fed by the rotary feeding member.

9 Claims, 19 Drawing Sheets

(56) References Cited

U.S. PATENT DOCUMENTS

| | | | | |
|---|---|---|---|---|
| 9,567,172 | B2 | 2/2017 | Chiba et al. | |
| 2008/0012201 | A1* | 1/2008 | Nakashima | B65H 3/0684 271/12 |
| 2013/0250328 | A1* | 9/2013 | Ohtsuka | H04N 1/0066 358/1.13 |
| 2016/0137445 | A1* | 5/2016 | Wynn | G03G 15/5029 271/171 |
| 2017/0185025 | A1 | 6/2017 | Wakabayashi et al. | |
| 2018/0273324 | A1* | 9/2018 | Takashima | B65H 3/0676 |

FOREIGN PATENT DOCUMENTS

| | | | |
|---|---|---|---|
| JP | H06-286886 | A | 10/1994 |
| JP | 2017-114638 | A | 6/2017 |

* cited by examiner

SHEET FEEDING APPARATUS AND IMAGE FORMING APPARATUS

BACKGROUND OF THE INVENTION

Field of the Invention

The present invention relates to a sheet feeding apparatus for feeding sheets, and an image forming apparatus equipped with the sheet feeding apparatus.

Description of the Related Art

In general, image forming apparatuses such as printers are configured to feed sheets stored in a cassette though use of a pickup roller, and form images on the fed sheets by image forming units. Hitherto, as disclosed in Japanese Patent Laid-Open No. H06-286886, a sheet feeder has a side guide plate for regulating a position of a sheet stored in a cassette with respect to a width direction orthogonal to a sheet feeding direction. The sheet feeder is arranged such that a pickup roller is positioned in an obliquely inclined position with respect to the sheet conveyance direction, which is a direction of extension of a conveyance path, and the pickup roller is used to feed the sheets following the side guide plate. Thereby, the sheet is aligned against the side guide plate, by which skewing of the sheet is reduced. Further, as illustrated for example in Japanese Patent Laid-Open No. 2017-114638, a sheet conveyance apparatus including a load member arranged between a sheet regulation member and a sheet conveyance unit and applying load to the sheet is known.

However, the pickup roller disclosed in above-described Japanese Patent Laid-Open No. H06-286886 conveys the sheet obliquely with respect to the sheet conveyance direction, and it must realize the functions of feeding the sheet and pressing the sheet against the side guide plate. Therefore, the pickup roller had a drawback in that it cannot correspond to feeding sheets having a wide variety of grammage or sizes.

Moreover, according to the configuration of the sheet conveyance apparatus disclosed in Japanese Patent Laid-Open No. 2017-114638, during conveyance of the sheet by the sheet conveyance unit, the sheet may be damaged by shear deformation that occurs between the sheet conveyance unit and the load member during conveyance of the sheet.

SUMMARY OF THE INVENTION

According to one aspect of the present invention, a sheet feeding apparatus includes a sheet supporting portion configured to support a sheet, a rotary feeding member configured to contact the sheet supported on the sheet supporting portion, apply feeding force in a sheet feeding direction and feed the sheet, a regulating portion comprising a contact surface configured to be in contact with an edge portion in a width direction orthogonal to the sheet feeding direction of the sheet supported on the sheet supporting portion, the regulating portion configured to regulate a position of the edge portion, and a force applying portion that is provided separately from the rotary feeding member, configured to contact the sheet supported on the sheet supporting portion upstream in a conveyance direction of the rotary feeding member and apply force to turn the sheet fed by the rotary feeding member.

Further features of the present invention will become apparent from the following description of exemplary embodiments with reference to the attached drawings.

DESCRIPTION OF THE EMBODIMENTS

First Embodiment

Overall Configuration

Figure 1:
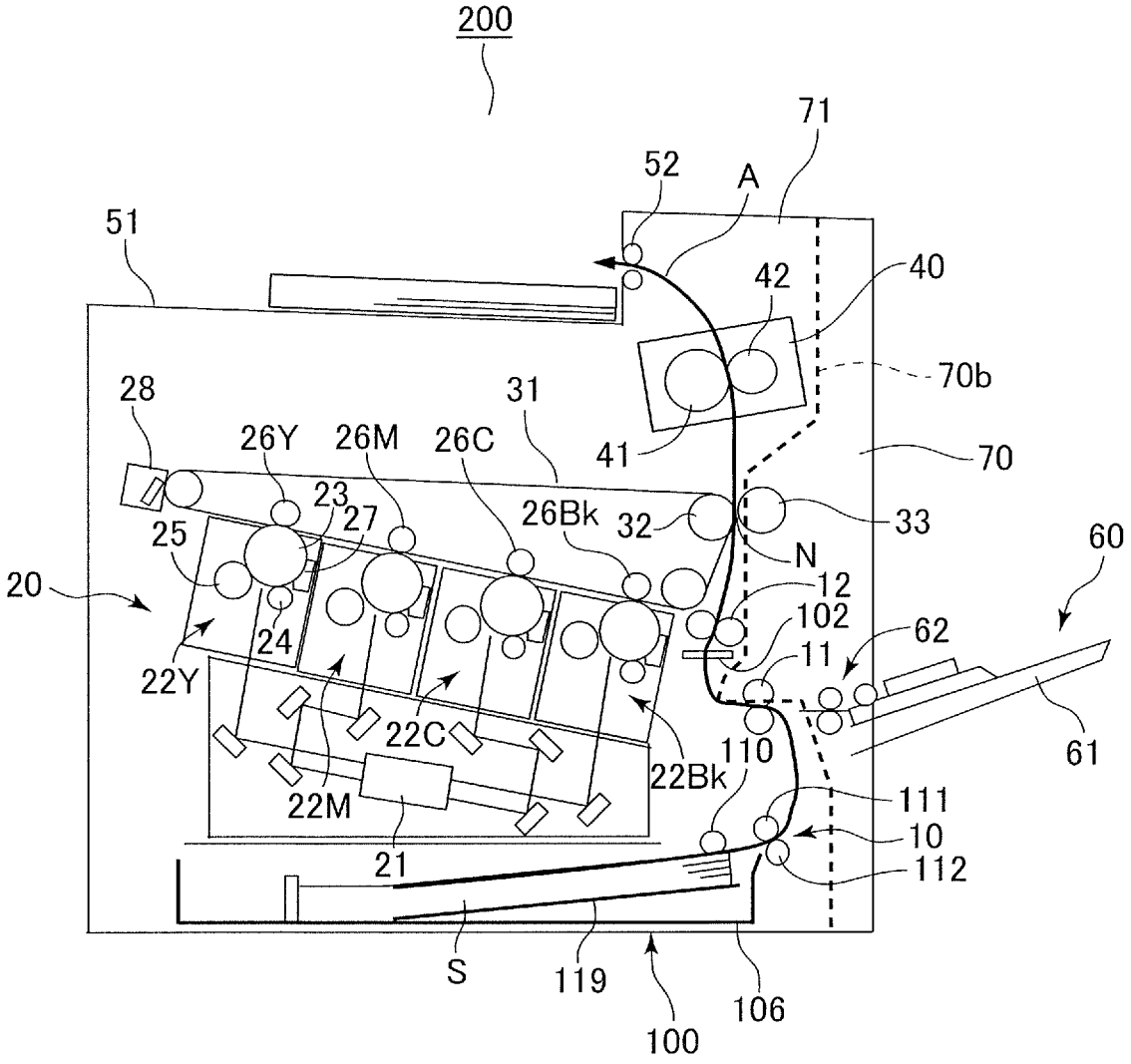
FIG. 1 is an entire schematic diagram illustrating a printer according to a first embodiment.

Now, a first embodiment according to the present invention will be described. A printer 200 serving as an image forming apparatus is a laser beam printer adopting an electrophotographic system, and as illustrated in FIG. 1, the printer 200 includes an image forming unit 20 that forms an image on a sheet S, a sheet feeding apparatus 100, and a fixing unit 40. The image forming unit 20 includes four process cartridges 22Y, 22M, 22C and 22Bk respectively forming toner images of four colors, which are yellow (Y), magenta (M), cyan (C) and black (Bk), and a scanner unit 21.

The configurations of the four process cartridges 22Y, 22M, 22C and 22Bk are the same, except for the difference in colors of the image being formed. Therefore, only the configuration and the image forming process of the process cartridge 22Y will be described, and process cartridges 22M, 22C and 22Bk will not be described.

The process cartridge 22Y includes a photosensitive drum 23, a charging roller 24, a developing roller 25, and a cleaning device 27. The photosensitive drum 23 has an organic photoconductive layer coated on an outer circumference of an aluminum cylinder, and it is rotated by a drive motor not shown. Further, the image forming unit 20 includes an intermediate transfer belt 31 rotated by a driving roller 32, and primary transfer rollers 26Y, 26M, 26C and 26Bk are arranged on an inner side of the intermediate transfer belt 31.

The fixing unit 40 includes a fixing film 41 heated by a heater serving as a heating portion, and a pressure roller 42 in pressure contact with the fixing film 41. The sheet feeding apparatus 100 is provided at a lower portion of the printer 200 and includes a cassette 106 storing a sheet and a sheet feeding unit 10 for feeding sheets.

Next, we will describe an image forming operation of the printer 200 configured as described. In a state where an image signal from a personal computer or the like not shown is entered to the scanner unit 21, a laser beam corresponding to the image signal is irradiated from the scanner unit 21 to the photosensitive drum 23 of the process cartridge 22Y.

The surface of the photosensitive drum 23 is charged uniformly in advance by the charging roller 24 to predetermined polarity and potential, and an electrostatic latent image is formed on the surface by having laser beams irradiated thereto from the scanner unit 21. The electrostatic latent image formed on the photosensitive drum 23 is developed by the developing roller 25, and a yellow (Y) toner image is formed on the photosensitive drum 23.

Similarly, laser beams are irradiated from the scanner unit 21 to the respective photosensitive drums of the process cartridges 22M, 22C and 22Bk, and magenta, (M), cyan (C) and black (Bk) toner images are formed on the respective photosensitive drum. The toner images of respective colors formed on the respective photosensitive drums are transferred by primary transfer rollers 26Y, 26M, 26C and 26Bk to the intermediate transfer belt 31, and conveyed by the intermediate transfer belt 31 rotated by the driving roller 32 to a secondary transfer roller 33.

The image forming processes of the respective colors are performed at timings set to superpose the toner image to a toner image primarily transferred to the intermediate transfer belt 31 at an upstream position. After toner images of respective colors are transferred to the intermediate transfer belt 31, the toner remaining on the surface of the photosensitive drum 23 is removed by a cleaning device 27.

In parallel with the image forming process, after a sheet S stored in the cassette 106 of the sheet feeding apparatus 100 is sent out by the sheet feeding unit 10, the sheet S is conveyed to a registration roller pair 12. A top sensor 102 is provided upstream in the sheet conveyance direction of the registration roller pair 12, and the top sensor 102 detects leading edge and trailing edge positions of the sheet being conveyed. The sheet S whose skewing has been corrected by the registration roller pair 12 is conveyed at a predetermined conveyance timing based on a detection result of the top sensor 102. A full-color toner image on the intermediate transfer belt 31 is transferred by secondary transfer bias applied on the secondary transfer roller 33 to the sheet S. Residual toner remaining on the intermediate transfer belt 31 is collected by a cleaner unit 28.

The sheet S onto which toner image has been transferred is subjected to predetermined heat and pressure by the fixing film 41 and the pressure roller 42 of the fixing unit 40, by which toner is melted and fixed. The sheet S passed through the fixing unit 40 is discharged by a sheet discharge roller pair 52 onto a sheet discharge tray 51. Arrow A illustrated in FIG. 1 is an example of a conveyance path through which the sheet S is conveyed from the cassette 106 to the sheet discharge roller pair 52.

Further, the printer 200 includes a cover 70 supported to open and close with respect to a printer body 71 serving as an apparatus body, in order to cope with jammed sheets, and a multi-purpose feeding apparatus 60. The multi-purpose feeding apparatus 60 is used for feeding sheets having irregular sizes and includes a multi-purpose tray 61 on which sheets are stacked manually by a user, and a multi-purpose feeding portion 62 for feeding sheets supported on the multi-purpose tray 61.

Sheet Feeding Apparatus

Figure 2A:
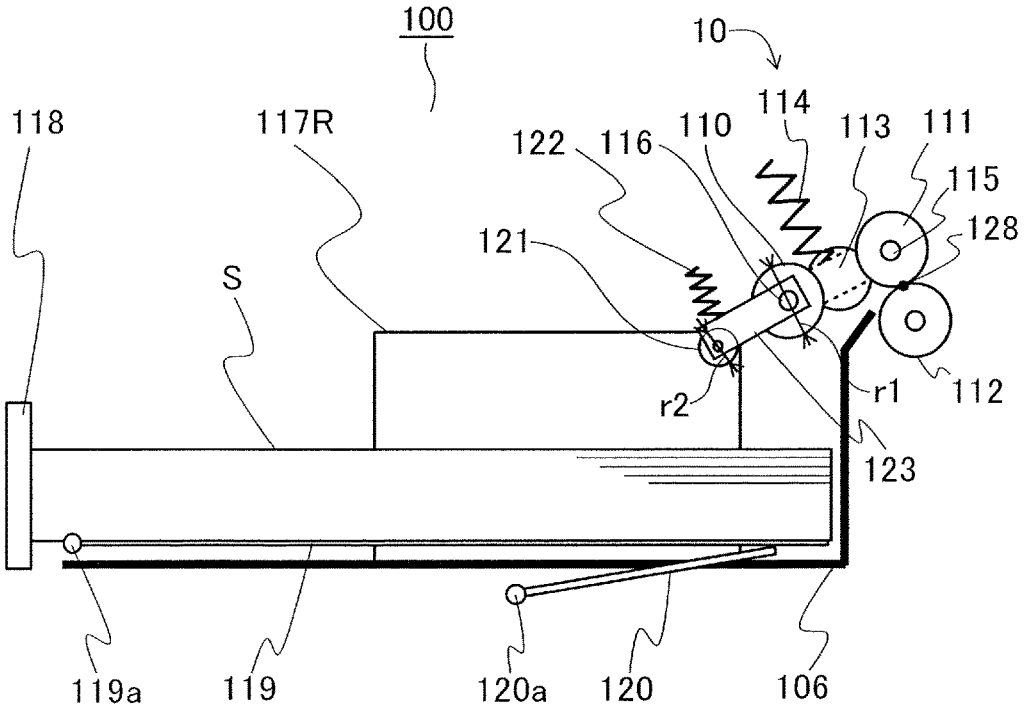
FIG. 2A is a side view illustrating a sheet feeding apparatus in a state where a sheet supporting portion is lowered.

The sheet feeding apparatus 100 includes the above-described cassette 106 and sheet feeding unit 10, as illustrated in FIG. 2A, and a sheet supporting portion 119 on which sheets S are supported, the sheet supporting portion 119 supported liftably around a pivot axis 119*a* in the cassette 106. At a lower area of the sheet supporting portion 119, a lifter plate 120 is supported pivotably around a pivot axis 120*a*. If the lifter plate 120 is lifted, as illustrated in FIG. 2B, the sheet supporting portion 119 is lifted, and the sheet S supported on the sheet supporting portion 119 comes into contact with a pickup roller 110 of the sheet feeding unit 10 and an obliquely conveying roller 121 arranged upstream of the pickup roller 110.

Figure 2B:
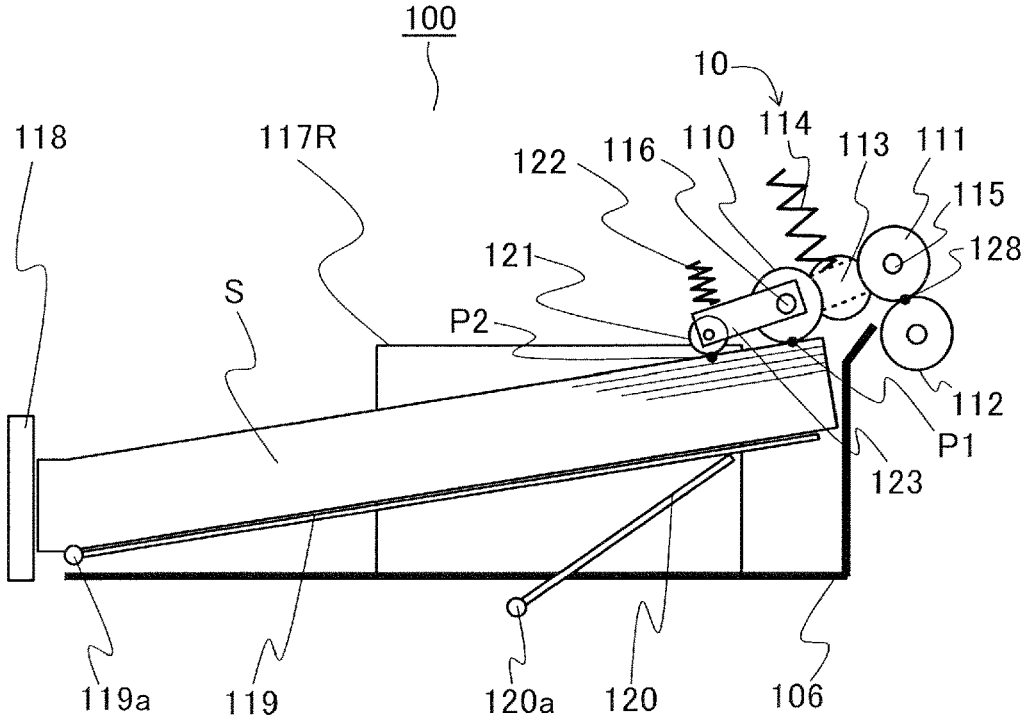
FIG. 2B is a side view illustrating the sheet feeding apparatus in a state where the sheet supporting portion is lifted.
Figure 3:
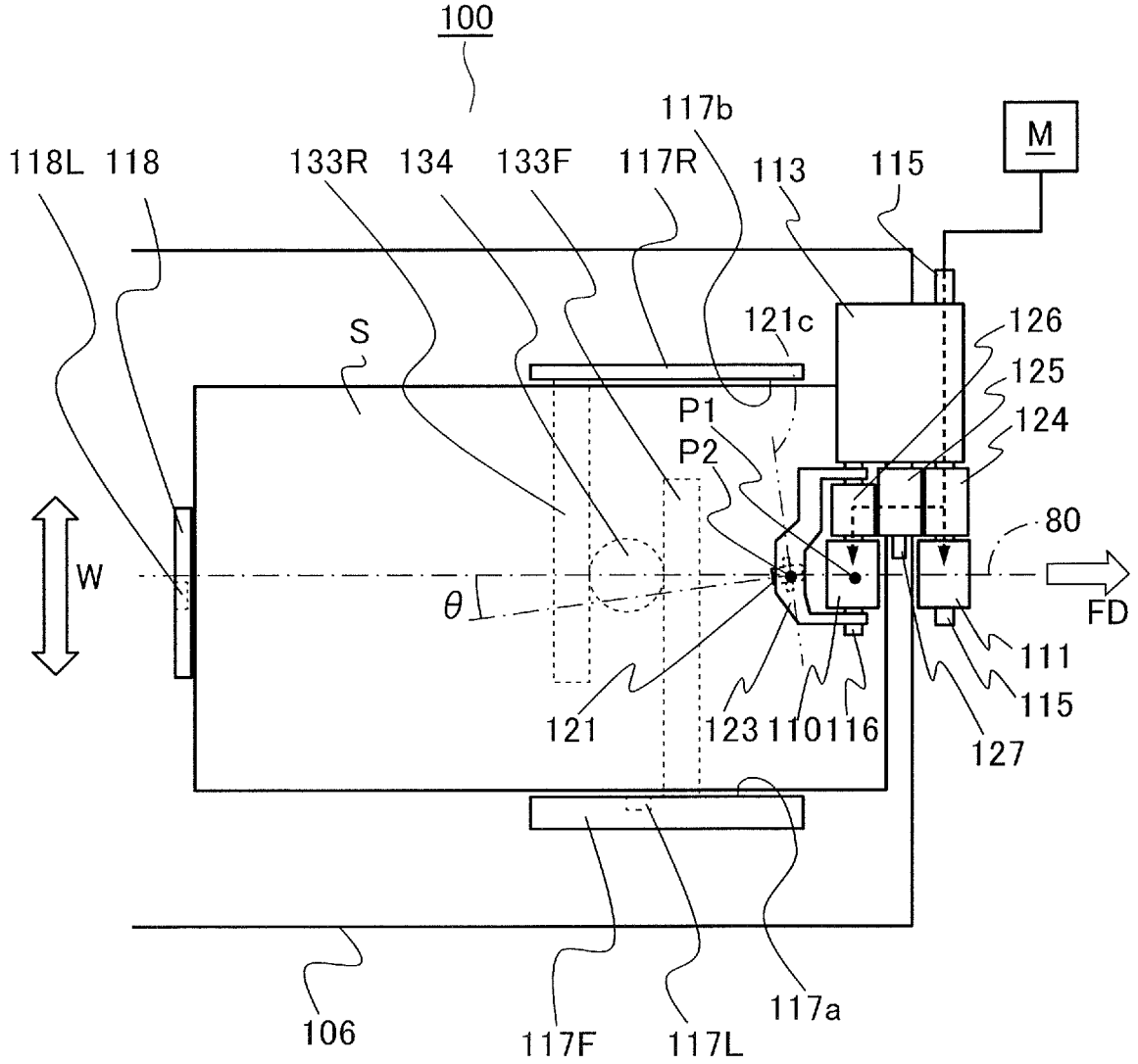
FIG. 3 is a plan view illustrating the sheet feeding apparatus.

Further, as illustrated in FIGS. 2A, 2B and 3, side regulating guides 117F and 117R and a trailing edge regulating guide 118 are provided in the cassette 106. The trailing edge regulating guide 118 is supported movably in the sheet feeding direction, and regulates the position of a trailing edge, that is, an upstream edge in the sheet feeding direction, of the sheet S supported on the sheet supporting portion 119. The trailing edge regulating guide 118 can be fixed by a fixing portion 118L at a position corresponding to sheet size.

The side regulating guides 117F and 117R serving as regulating portions respectively have contact surfaces 117*a* and 117*b* capable of being in contact with edge portions in a width direction orthogonal to the sheet feeding direction of the sheet S supported on the sheet supporting portion 119, and they are configured slidably in the width direction. Further, the side regulating guides 117F and 117R respectively have interlocking racks 133F and 133R extending in the width direction, and the interlocking racks 133F and 133R are configured to be interlocked with one another by meshing through a pinion gear 134.

That is, in a state where the side regulating guide 117F moves toward the outer side of the cassette 106 in the width direction, the side regulating guide 117R also moves outward, and if the side regulating guide 117F moves toward the inner side of the cassette 106 in the width direction, the side regulating guide 117R also moves inward. The side regulating guides 117F and 117R serving as first and second guides are configured to regulate both edge portions in the width direction of the sheet supported on the sheet supporting portion 119 by contact surfaces 117*a* and 117*b*. The side regulating guide 117F can be fixed by a fixing portion 117L.

Feeding Portion

Next, the sheet feeding unit 10 will be described in detail. The sheet feeding unit 10 includes, as illustrated in FIGS. 2A, 2B and 3, a drive shaft 115 to which a driving force of a motor M is entered, a holder 113 supported rotatably on the drive shaft 115, and a pickup roller shaft 116 supported rotatably on the holder 113. A feed roller 111 and a feed gear 124 are attached to the drive shaft 115.

An idler shaft 127 to which an idler gear 125 meshed with the feed gear 124 is attached is rotatably supported on the holder 113, and a pickup roller gear 126 meshed with the idler gear 125 is attached to the pickup roller shaft 116. Further, the pickup roller 110 serving as a rotary feeding member and an arm 123 are attached to the pickup roller shaft 116 serving as a rotation shaft.

Figure 4:
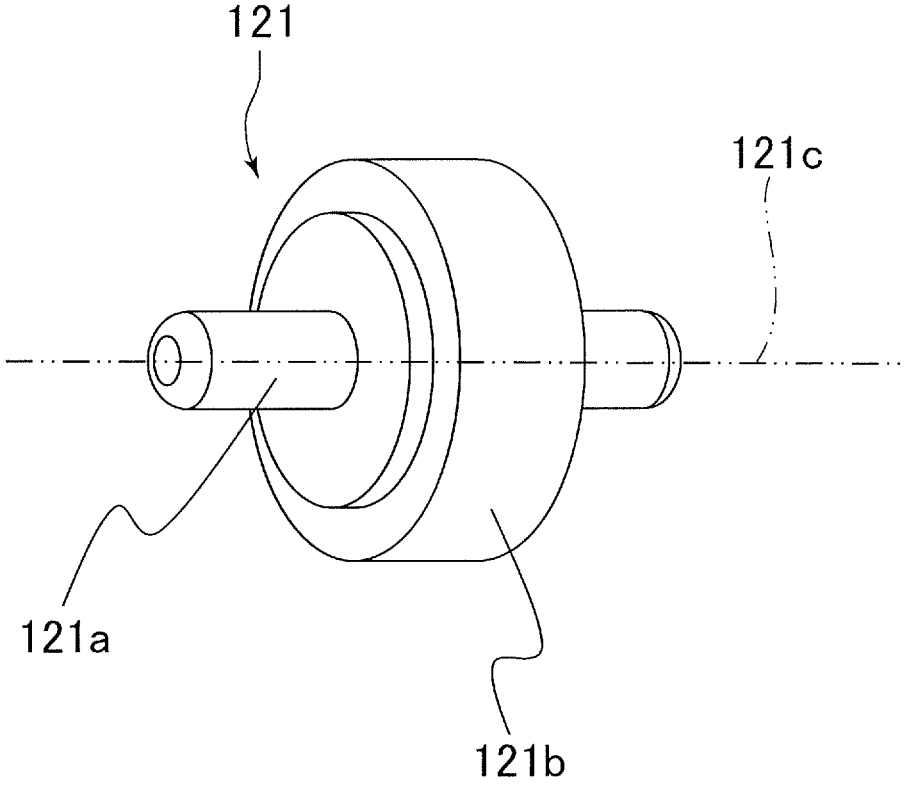
FIG. 4 is a perspective view illustrating an obliquely conveying roller.

As illustrated in FIG. 4, the arm 123 rotatably supports the obliquely conveying roller 121 serving as a force applying portion or a rotary member, and the obliquely conveying roller 121 includes a core 121*a* having a shaft portion, and an outer layer 121*b* that comes into contact with the sheet. The outer layer 121*b* is composed of a material that generates a large frictional force between the sheet S, such as EPDM rubber (ethylene propylene diene rubber) or urethane rubber. Further, as illustrated in FIG. 3, the obliquely conveying roller 121 is arranged obliquely by angle θ with respect to a conveyance center line 80 in the width direction of the sheet supporting portion 119 and provided separately from the pickup roller 110. That is, a rotational axis 121*c* of the obliquely conveying roller 121 is oblique with respect to a width direction (direction of arrow W of FIG. 3) orthogonal to the sheet feeding direction (direction of arrow FD of FIG. 3) when viewed from the thickness direction of the sheet. The angle θ can be set freely, but a preferable angle is from 5 to 10 degrees. Further, as illustrated in FIG. 2A, an outer diameter r2 of the obliquely conveying roller 121 is set smaller than an outer diameter r1 of the pickup roller 110.

As illustrated in FIGS. 2A and 2B, the holder 113 is urged downward by a pickup spring 114 serving as a first urging member, and the arm 123 is urged downward by a roller spring 122 serving as a second urging member. That is, the pickup roller 110 is urged toward the sheet supported on the sheet supporting portion 119 by the pickup spring 114 through the holder 113. Further, the obliquely conveying roller 121 is urged toward the sheet supported on the sheet supporting portion 119 by the roller spring 122 through the arm 123. A weight can be used instead of the pickup spring 114 and the roller spring 122, by which the pickup roller 110 and the holder 113 urge the pickup roller 110 toward the sheet by their own weight, or according to which the obliquely conveying roller 121 and the arm 123 urge the obliquely conveying roller 121 toward the sheet by their own weight.

Further, as illustrated in FIG. 3, in a state where driving force of the motor M is entered to the drive shaft 115, the feed roller 111 and the feed gear 124 attached to the drive shaft 115 rotate. The rotation of the feed gear 124 is transmitted through the idler gear 125 to the pickup roller gear 126, and by the rotation of the pickup roller gear 126, the pickup roller 110 rotates via the pickup roller shaft 116. At this time, the directions of rotation of the feed roller 111 and the pickup roller 110 are the same.

As illustrated in FIGS. 2A and 2B, a separation roller 112 forming a nip 128 with the feed roller 111 is arranged below the feed roller 111, and a torque limiter not shown is attached to the separation roller 112. By the action of the torque limiter, the sheets entering the nip 128 are separated one by one. Further, a rotational drive to an opposite direction as the sheet feeding direction can be entered to the separation roller 112.

As illustrated in FIG. 2A, if the motor M (refer to FIG. 3) is rotated in a state where the pickup roller 110 and the obliquely conveying roller 121 are in contact with the sheet S, the sheet S is fed by the pickup roller 110 and the obliquely conveying roller 121. The sheet S fed by the pickup roller 110 and the obliquely conveying roller 121 is separated one by one at the nip 128 formed by the feed roller 111 and the separation roller 112, and conveyed toward a registration roller pair 11 (refer to FIG. 1).

Force Acting on Sheet

Figure 5A:
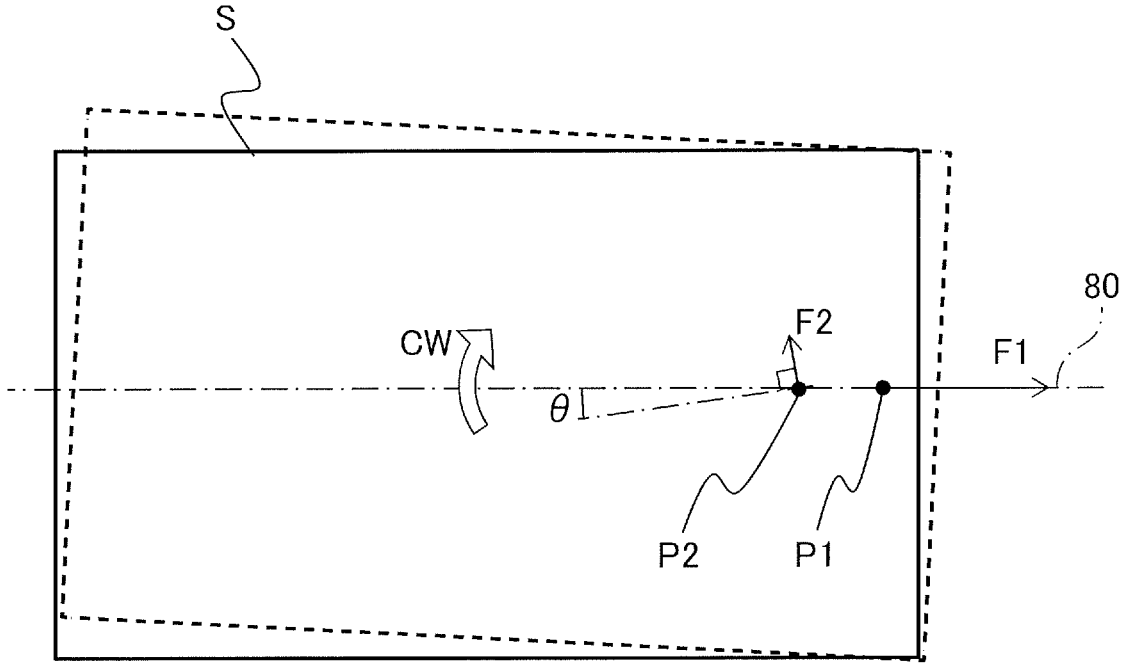
FIG. 5A is an explanatory view configured to describe a feeding force and a turning force that act on the sheet.

Next, a force acting on the sheet S in a state where sheet feeding operation has been started will be described. As illustrated in FIG. 5A, the pickup roller 110 contacts the sheet S at a contact point P1 serving as a second contact portion and a fourth contact portion, and the obliquely conveying roller 121 contacts the sheet S at a contact point P2 serving as a first contact portion. If the force that the sheet S receives at contact point P1 is referred to as F1, and the force that the sheet S receives at contact point P2 is referred to as F2, F1 and F2 can be expressed as follows.

$$F1=\mu 1\times N1$$

$$F2=\mu 2\times N2$$

In the expression, μ1 represents friction coefficient of the sheet S and the pickup roller 110, and N1 represents pressing force of the pickup roller 110 with respect to the sheet S at contact point P1. Further, μ2 represents friction coefficient of the sheet S and the obliquely conveying roller 121, and N2 represents pressing force of the obliquely conveying roller 121 with respect to the sheet S at contact point P2. The directions of F1 and F2 represent directions of vector indicated by the arrow of FIG. 5A.

Figure 5B:
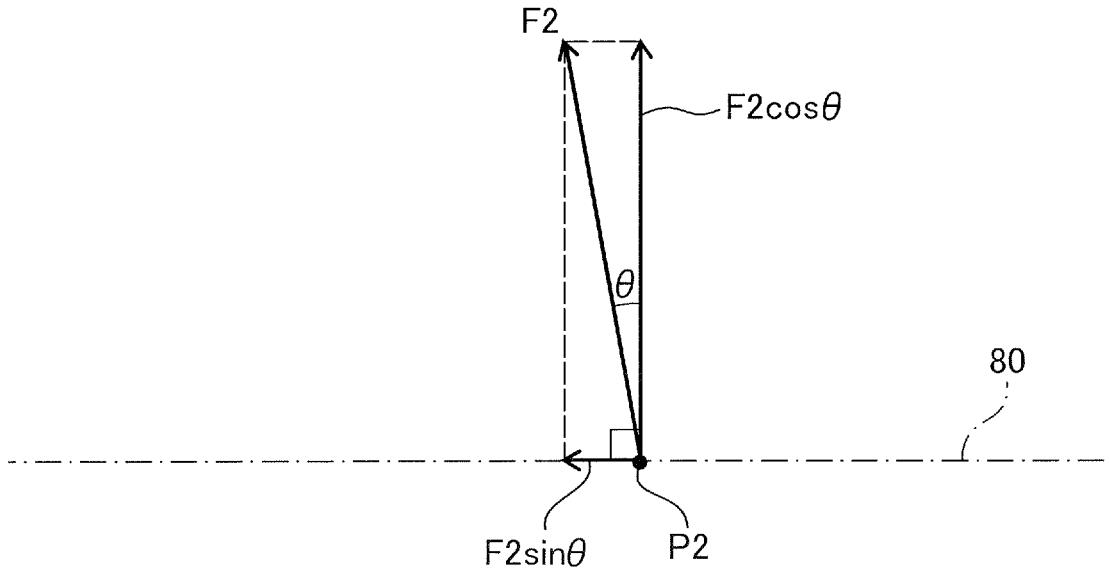
FIG. 5B is an explanatory view illustrating a component of force of the turning force.

As illustrated in FIG. 5B, force F2 can be decomposed into F2 sin θ, which is a force applied along the conveyance center line 80, and F2 cos θ, which is a force applied along the width direction. The sheet S is turned (pivoted) by force F2 cos θ from the force F2 that the obliquely conveying roller 121 applies to the sheet S. In other words, the sheet S attempts to move in the sheet feeding direction by force F1, which is a force fed by the pickup roller 110, but since force F2 cos θ is applied at contact point P2, the sheet moves in the sheet feeding direction while being turned in direction CW approximately around the contact point P1. Therefore, in a state where the sheet S is fed by the pickup roller 110 and the obliquely conveying roller 121, the sheet S attempts to change from the position illustrated by the solid line to the position illustrated by the broken line of FIG. 5A. Hereafter, force F1 is referred to as feeding force, and F2 is referred to as turning force. Further, the conveyance center line 80 is a linear line connecting contact point P1 and contact point P2, and it is extended in parallel with the sheet feeding direction.

Change of Sheet Position

Next, how the sheet S is fed while changing positions will be described in detail, based on the state in which the sheet S is supported. At first, a case is described in which a gap exists between the sheet S and the side regulating guides 117F and 117R. The side regulating guides 117F and 117R can be moved to correspond to regular sheet sizes such as A3, A4, A5, LTR and LGL, and can be fixed by the fixing portion 117L. Normally, in order to enhance sheet setting performance and cope with variation of sheet size, it is common to position the side regulating guides 117F and 117R at a distance 1 to 2 mm wider than the actual sheet width of the regular sized sheet.

Figure 6A:
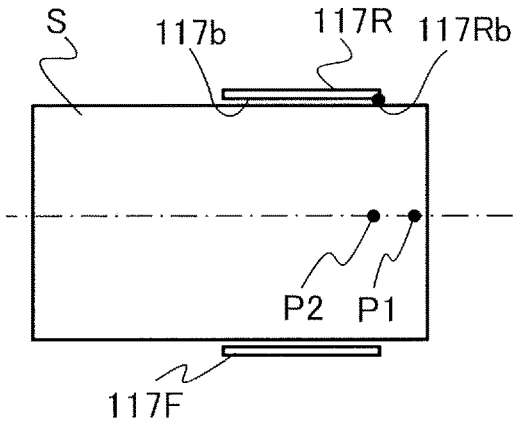
FIG. 6A is a view illustrating that a gap is formed between the sheet and a side regulating guide.

Then, as illustrated in FIG. 6A, a gap is formed between the sheet S and the side regulating guides 117F and 117R. In the case of a sheet feeding apparatus of the type where only feeding force from the pickup roller, i.e., force F1 according to the present embodiment, is applied on the sheet S to feed the sheet, the position of the sheet may be varied by the gap during setting of the sheet S or during feeding operation of the sheet S and skewing of the sheet may be caused.

Figure 6B:
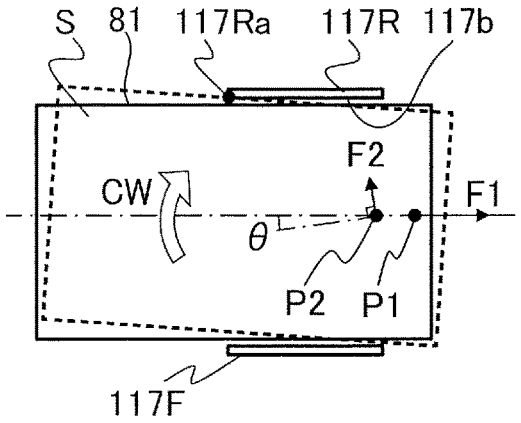
FIG. 6B is a view illustrating a state in which the sheet is turned to direction CW.
Figure 6C:
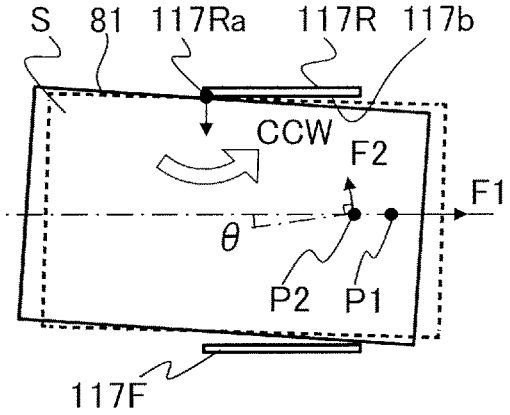
FIG. 6C is a view illustrating a state in which the sheet is turned to direction CCW.
Figure 6D:
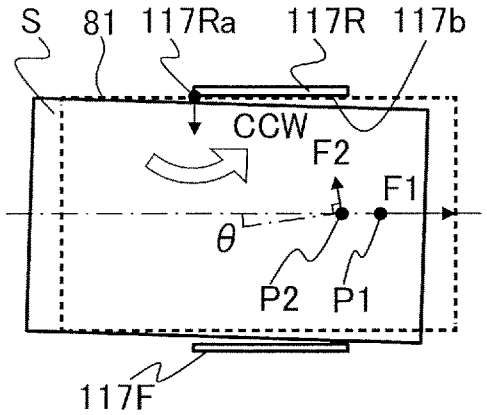
FIG. 6D is a view illustrating a state in which the sheet is turned to follow the side regulating guide.

Change of position of the sheet S according to the present embodiment will be illustrated in FIGS. 6B through 6D, and the drawings show the change of position from the position illustrated by the solid line to the position illustrated by the broken line. In the present embodiment, in addition to feeding force F1 applied by the pickup roller, turning force F2 is applied by the obliquely conveying roller 121 to the sheet S, such that the sheet S is fed while being turned in direction CW, as illustrated in FIG. 6B. Then, an edge portion 81 in the width direction of the sheet S collides against an upstream edge 117Ra in the sheet feeding direction of the contact surface 117*b* of the side regulating guide 117R. Thus, the turning movement of the sheet S in direction CW pivoting around a vicinity of contact point P1 is inhibited by the upstream edge 117Ra.

In a state where the sheet S is fed further, the sheet S turns in direction CCW, which is opposite to direction CW, around the upstream edge 117Ra of the contact surface 117*b* by turning force F2, as illustrated in FIG. 6C. Then, as illustrated in FIG. 6D, the edge portion 81 in the with direction of the sheet S follows the contact surface 117*b*, such that the edge portion 81 is positioned in parallel with the contact surface 117*b*.

Figure 6E:
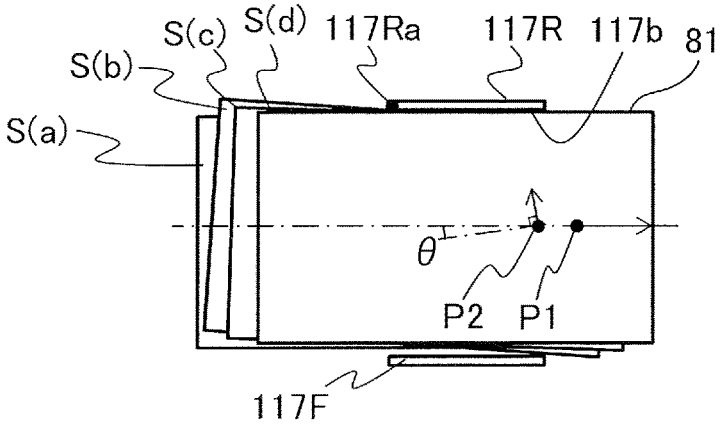
FIG. 6E is a view illustrating a change of position of sheet.

That is, as illustrated in FIG. 6E, the sheet S moves, in the named order, from position S (a), position S (b), position S (c) to position S (d), and finally, the sheet S is fed in a state where the edge portion 81 of the sheet S is positioned in parallel with the contact surface 117*b*. Thereby, skewing of the sheet S is reduced.

Figure 7A:
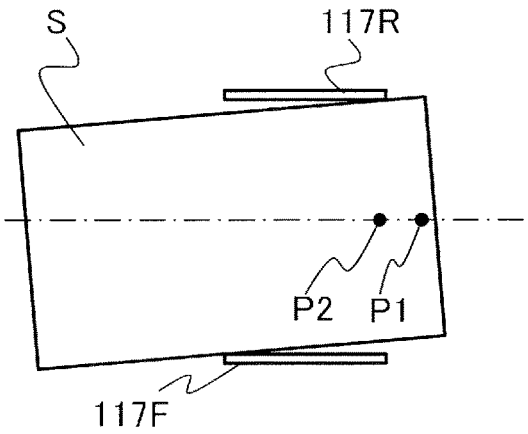
FIG. 7A is a view illustrating a sheet in an oblique position.

Next, as illustrated in FIG. 7A, a case will be described where a sheet S supported on the sheet supporting portion 119 positioned such that the trailing edge is inclined toward the front side of the apparatus, that is, inclined toward the side regulating guide 117F, is fed. The change of position of the sheet S in the present embodiment is illustrated in FIGS. 7B and 7C, and in the respective drawings, the sheet position is changed from the position illustrated by the solid line to the position illustrated by the broken line.

Figure 7B:
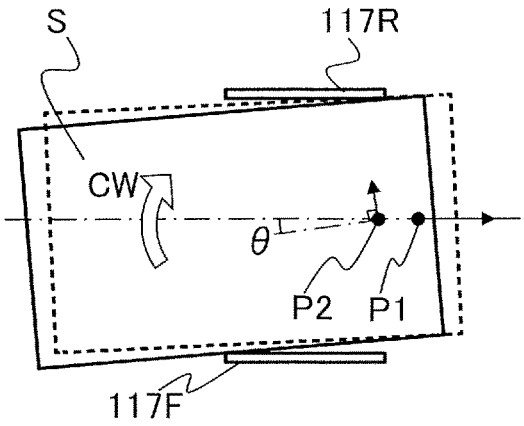
FIG. 7B is a view illustrating a state in which the sheet is turned to direction CW.
Figure 7C:
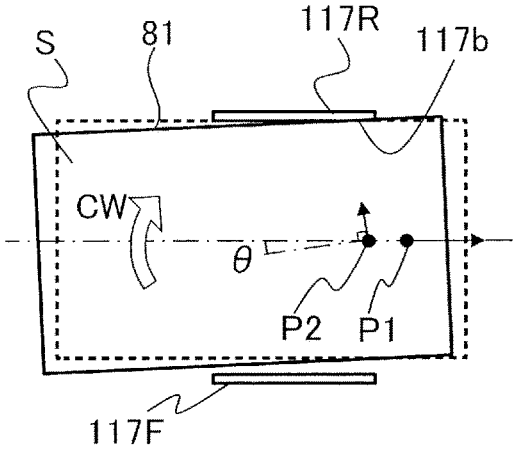
FIG. 7C is a view illustrating a state in which the sheet is turned to follow the side regulating guide.

In a state where the sheet feeding operation is started, as illustrated in FIG. 7B, the sheet S is fed while being turned in direction CW, pivoting around the vicinity of contact point P1. As a result, the trailing edge of the sheet that has been inclined toward the front side of the apparatus moves to the back side of the apparatus, and as illustrated in FIG. 7C, the edge portion 81 in the width direction of the sheet S follows the contact surface 117*b*, and the edge portion 81 becomes parallel with the contact surface 117*b*.

Figure 7D:
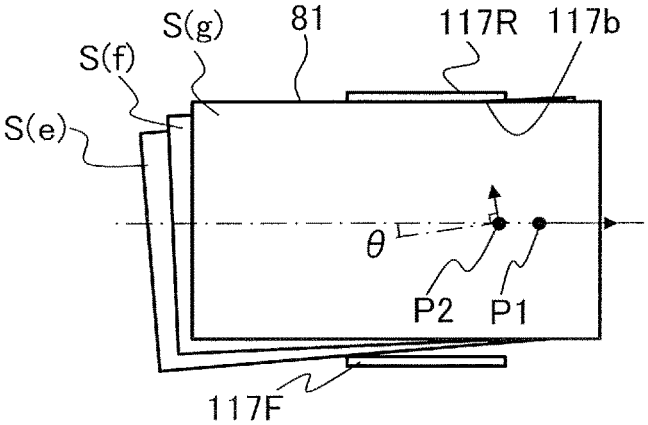
FIG. 7D is a view illustrating a change of position of the sheet.

That is, as illustrated in FIG. 7D, the sheet S moves in order from position S (e), position S (f) to position S (g), and finally, the sheet S is fed in a state where the edge portion 81 of the sheet S is positioned in parallel with the contact surface 117*b*. Thereby, skewing of the sheet S is reduced.

If the sheet S before the sheet feeding operation is started is positioned such that the trailing edge is inclined toward the back side of the apparatus, as illustrated in FIG. 6C, the sheet S will turn as described in FIGS. 6C and 6D, and description thereof is omitted.

As described, regardless of the position of the sheet S before the start of the sheet feeding operation, the sheet S will be turned while being fed, such that the edge portion 81 of the sheet S will follow the contact surface 117*b* of the side regulating guide 117R and skewing of the sheet S can be reduced.

Further, since the pickup roller 110 that applies feeding force F1 to the sheet S and the obliquely conveying roller 121 that applies turning force F2 to the sheet S are provided separately, the feeding force F1 and the turning force F2 can be set independently. Thus, the turning fore F2 can be set smaller than the feeding force F1, for example, to prevent the sheet S from being pressed against the side regulating guide 117R with a force stronger than the stiffness of the sheet and causing the sheet S to be damaged. Further, the present embodiment can cope with feeding of sheets having a wide variety of sizes and grammage. The feeding force F1 is set according to the shape of the pickup roller 110 and the urging force of the pickup spring 114. The turning force F2 is set according to the inclination angle and shape of the obliquely conveying roller 121 or the urging force of the roller spring 122.

According further to the present embodiment, as illustrated in FIG. 6A, the obliquely conveying roller 121 is arranged such that the contact point P2 is positioned upstream than the downstream edge 117Rb in the sheet feeding direction of the contact surface 117*b*. If the turning force F2 is applied to the sheet S at a position downstream in the sheet feeding direction than the side regulating guide 117R, such as at the position of contact point P1, the sheet S will be skewed after the training edge of the sheet S passes the downstream edge 117Rb of the side regulating guide 117R. According to the present configuration, the skewing of the sheet S can be reduced.

According to the present embodiment, there is no driving force applied to the obliquely conveying roller 121, and the obliquely conveying roller 121 is driven to rotate by the sheet S, but it is also possible to apply driving force to the obliquely conveying roller 121. However, the effect realized by the present embodiment will not be changed by applying driving force to the obliquely conveying roller 121, and costs will rise by increasing the number of components for applying such driving force, so it is preferable that the obliquely conveying roller 121 is merely driven to rotate.

Further, the outer diameter r2 of the obliquely conveying roller 121 is set smaller than the outer diameter r1 of the pickup roller 110, and as described above, driving force will not be applied to the obliquely conveying roller 121 and the necessary number of components is small, such that only a small space is necessary for installing the obliquely conveying roller 121. Therefore, the obliquely conveying roller 121 can be applied to various feeding apparatuses. Especially, the pickup roller 110 and the obliquely conveying roller 121 according to the present embodiment advantageously require less space compared to the arrangement where the pickup roller itself to which driving force is applied must be arranged obliquely with respect to the sheet conveyance direction, and the side regulating guides 117F and 117R can also be downsized according to the present arrangement.

Furthermore, the side regulating guides 117F and 117R according to the present embodiment may be arranged on either the front side or the back side of the apparatus. This arrangement is especially suitable for feeding tab sheets St illustrated in FIGS. 8A through 8C.

Figure 8A:
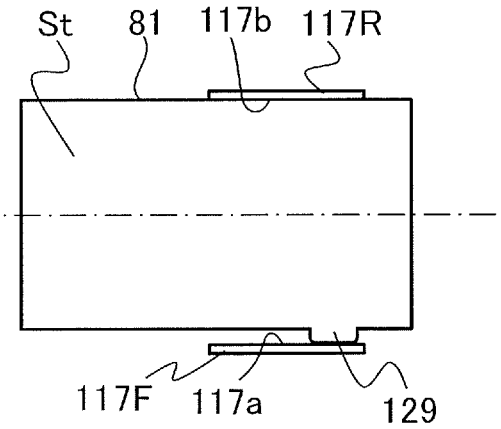
FIG. 8A is a view illustrating a tab sheet.
Figure 8B:
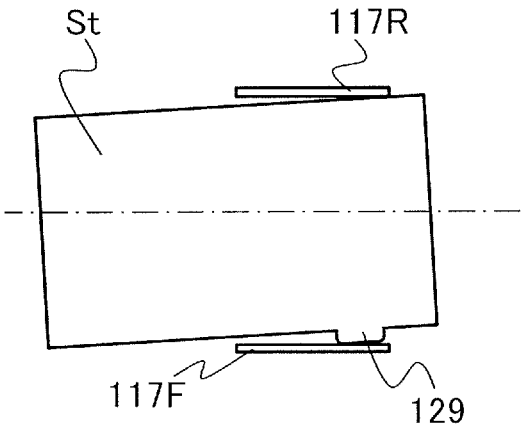
FIG. 8B is a view illustrating a tab sheet supported in a skewed state.
Figure 8C:
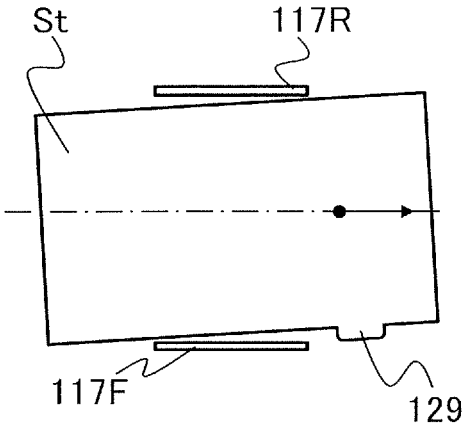
FIG. 8C is a view illustrating a tab sheet fed in a skewed state.

As illustrated in FIG. 8A, the tab sheet St has one edge portion 81 in the width direction sufficiently contact the contact surface 117*b* of the side regulating guide 117R and a tab 129 on the other edge that comes into contact with the contact surface 117*a* of the side regulating guide 117F. Therefore, as illustrated in FIG. 8B, the position of the tab sheet St may be misaligned when setting the sheet St. Further, as illustrated in FIG. 8C, in a state where the tab 129 passes the side regulating guide 117F while the tab sheet St is being fed, a gap is formed between the tab sheet St and the side regulating guides 117F and 117R, by which the tab sheet St may be skewed.

However, according to the present embodiment, only the side regulating guide 117R on the back side of the apparatus is required as the side regulating guide for aligning the position of the sheet S or the tab sheet St. Further, since the tab sheet St is fed while being constantly pressed against the contact surface 117*b* of the side regulating guide 117R, skewing of the tab sheet St can be reduced.

In the present embodiment, the obliquely conveying roller 121 is arranged in an oblique manner so as to press the sheet S against the side regulating guide 117R, but the present embodiment is not restricted thereto. For example, it is possible to arrange the obliquely conveying roller 121 symmetrically in the width direction with respect to the conveyance center line 80 and press the sheet S onto the side regulating guide 117F. Further, the obliquely conveying roller 121 is not required to be arranged on the conveyance center line 80.

Second Embodiment

Next, a second embodiment of the present invention will be described. The second embodiment adopts a friction member 130 instead of the obliquely conveying roller 121 of the first embodiment. Similar configurations as the first embodiment are either not shown in the drawing or denoted with the same reference numbers.

Friction Member

Figure 9:
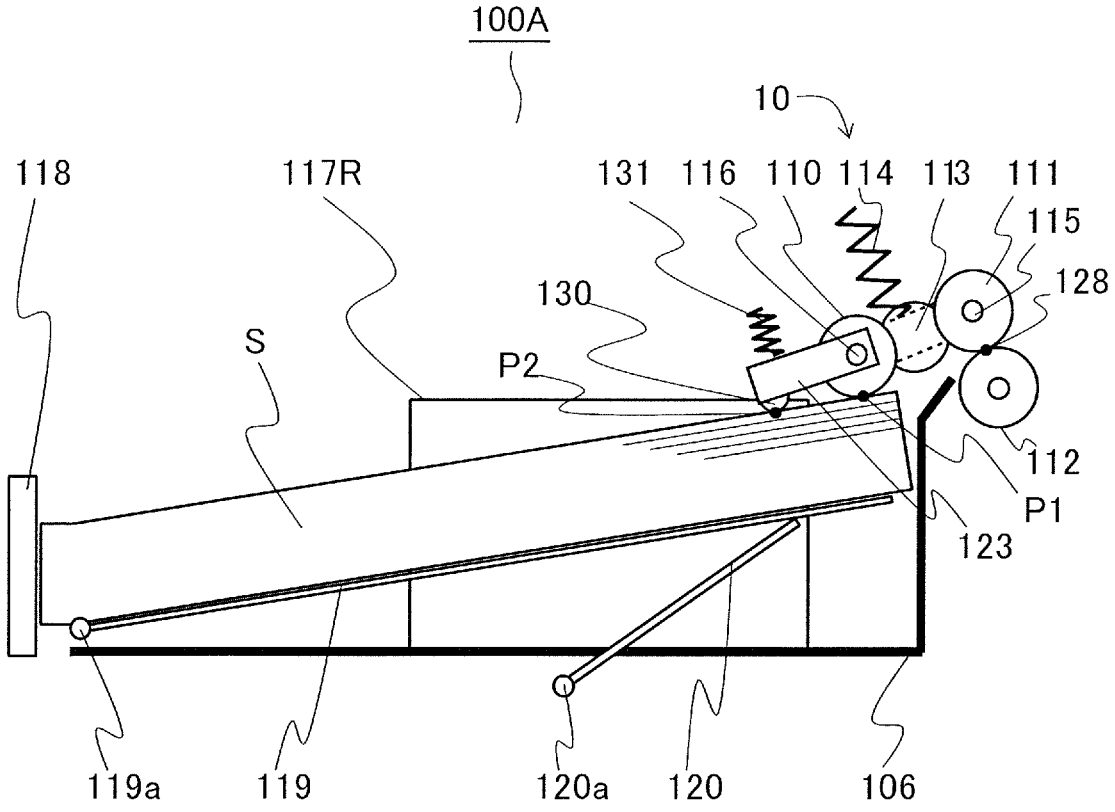
FIG. 9 is a side view illustrating a sheet feeding apparatus according to a second embodiment.
Figure 10:
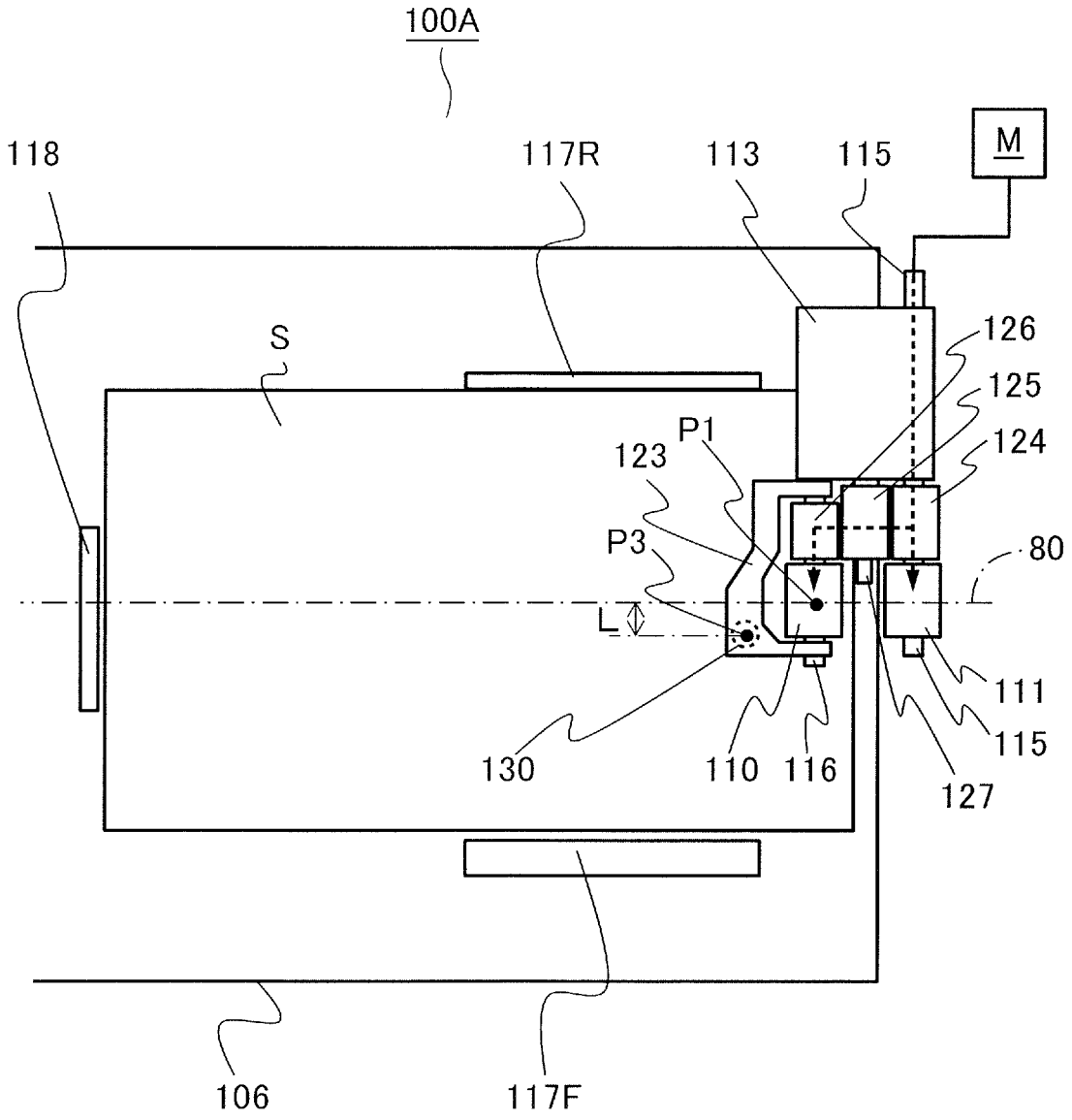
FIG. 10 is a plan view illustrating a sheet feeding apparatus.
Figure 11:
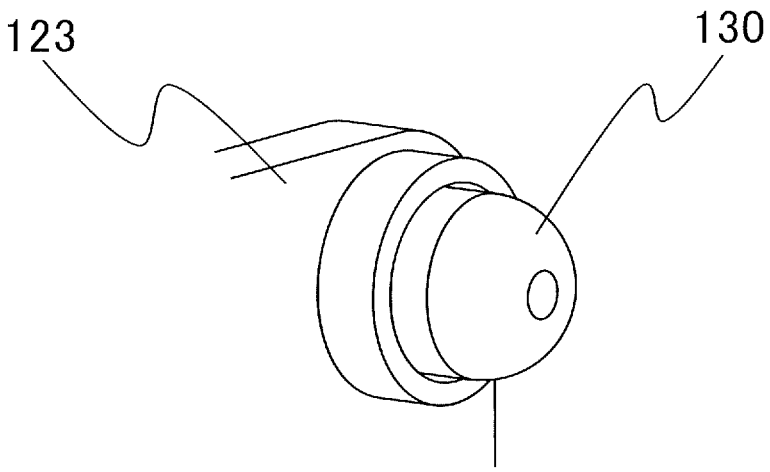
FIG. 11 is a perspective view illustrating a friction member.

A sheet feeding apparatus 100A includes, as illustrated in FIGS. 9 and 10, an arm 123 supported rotatably on a pickup roller shaft 116, and a friction spring 131 urging the arm 123 downward, wherein a friction member 130 is provided on a lower side of the arm 123. The friction member 130 serving as a force applying portion has an approximately spherically shaped contact surface, as illustrated in FIG. 11, and it is configured to contact the sheet S supported on the sheet supporting portion 119 (refer to FIG. 9).

Figure 12:
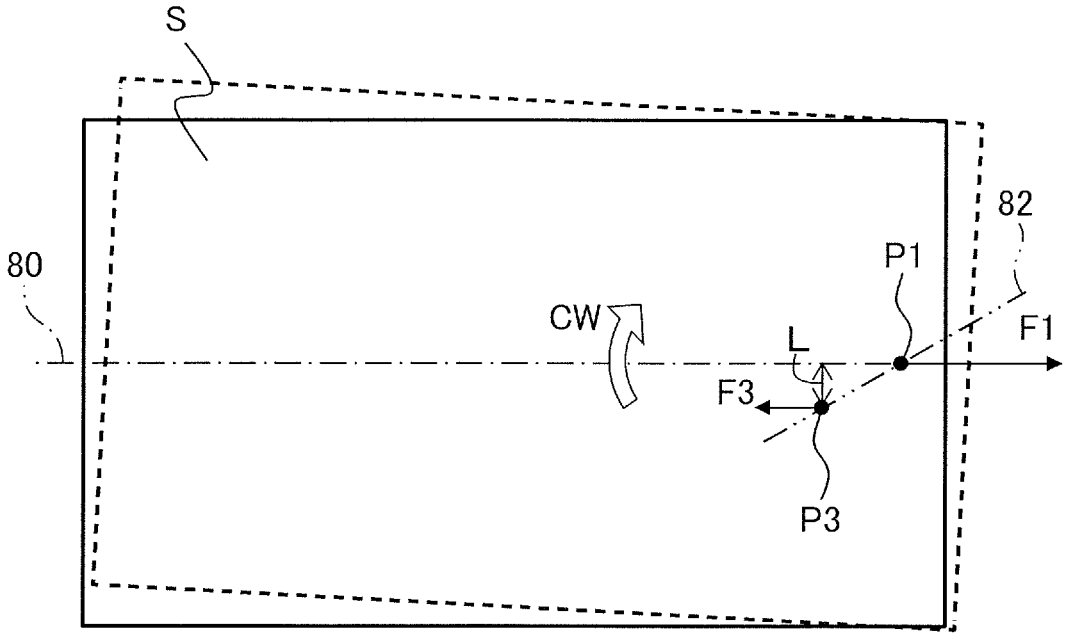
FIG. 12 is an explanatory view illustrating a feeding force and a turning force acting on the sheet.

The friction member 130 is urged toward the sheet S by the friction spring 131 through the arm 123, as illustrated in FIG. 9. Further, as illustrated in FIG. 10, the friction member 130 is in contact with the sheet S at a contact point P3 serving as a third contact portion, and the contact point P3 is displaced for distance L toward the front side of the apparatus with respect to the conveyance center line 80. Therefore, as illustrated in FIG. 12, a linear line 82 connecting the contact point P1 and the contact point P3 is inclined with respect to the conveyance center line 80 extending in the sheet feeding direction.

Force Acting on Sheet

Next, the force acting on the sheet S when the sheet feeding operation is started will be described. As illustrated in FIG. 12, the pickup roller 110 contacts the sheet S at contact point P1, and the friction member 130 contacts the sheet S at contact point P3. If the feeding force that the sheet S receives at contact point P1 is referred to as F1 and the turning force that the sheet S receives at contact point P3 is referred to as F3, F1 and F3 can be expressed as follows.

$$F1=\mu 1\times N1$$

$$F3=\mu 3\times N3$$

In the expression, μ1 represents friction coefficient of the sheet S and the pickup roller 110, and N1 represents pressing force of the pickup roller 110 against the sheet S at contact point P1. Further, μ3 represents friction coefficient of the sheet S and the friction member 130, and N3 represents pressing force of the friction member 130 against the sheet S at contact point P3. The directions of feeding force F1 and urging force F3 are vector directions shown by the arrows of FIG. 12, which are mutually opposite directions.

The sheet S attempts to move in the sheet feeding direction by the feeding force F1 applied from the pickup roller 110, but since the turning force F3 acts at contact point P3, the sheet S moves in the sheet feeding direction while turning in direction CW approximately around the contact point P1. Therefore, if the sheet S is fed by the pickup roller 110, the sheet S attempts to change positions from the position illustrated by the solid line to the position illustrated by the broken line of FIG. 12.

As described, also according to the present embodiment, the feeding force F1 and the turning force F3 are applied to the sheet S from different members, such that the feeding force F1 and the turning force F3 can be set independently.

Third Embodiment

Next, a third embodiment of the present invention will be described. According to the third embodiment, the friction member according to the second embodiment is arranged at a different position. Therefore, similar configurations as the second embodiment are either not shown in the drawing or denoted with the same reference numbers.

Figure 13:
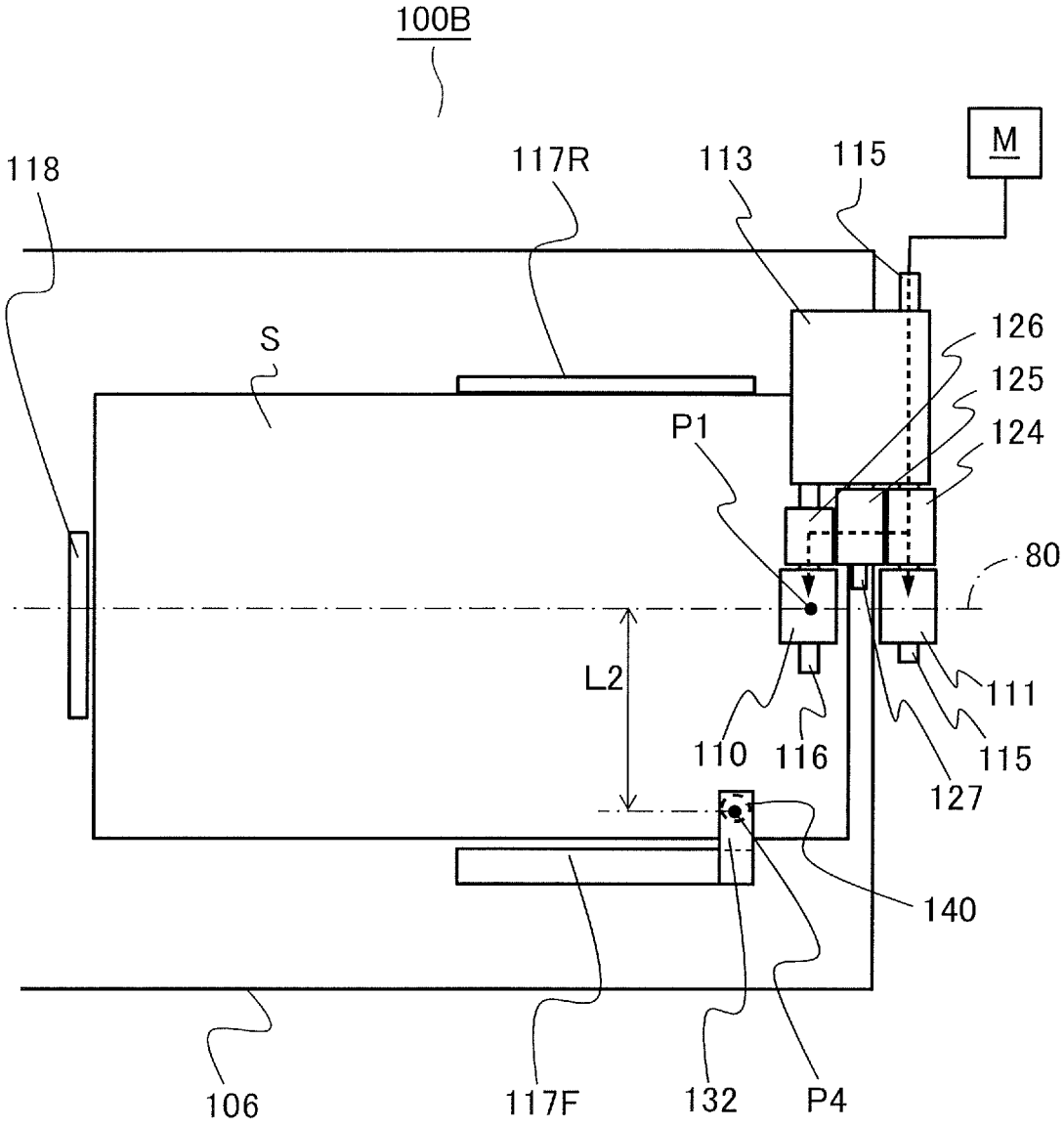
FIG. 13 is a plan view illustrating a sheet feeding apparatus according to a third embodiment.

As illustrated in FIG. 13, a sheet feeding apparatus 100B includes side regulating guides 117F and 117R, an arm 132 that extends in the width direction from the side regulating guide 117F, and a friction member 140 disposed at a leading edge of the arm 132. The friction member 140 serving as a force applying portion is in contact with the sheet S at contact point P4, and the contact point P4 is displaced for distance L2 toward the front side of the apparatus with respect to the conveyance center line 80.

Also according to the friction member 140, turning force can be applied to the sheet S, similar to the friction member 130 of the second embodiment. Moreover, since the friction member 140 is provided on the arm 132 extending from the side regulating guide 117F, the freedom of arrangement of the friction member 140 can be improved.

Fourth Embodiment

Next, we will describe a fourth embodiment of the present invention. According to the fourth embodiment, the friction member is arranged at a different position as the second embodiment. Therefore, similar configurations as the second embodiment are either not shown in the drawing or denoted with the same reference numbers.

Figure 14:
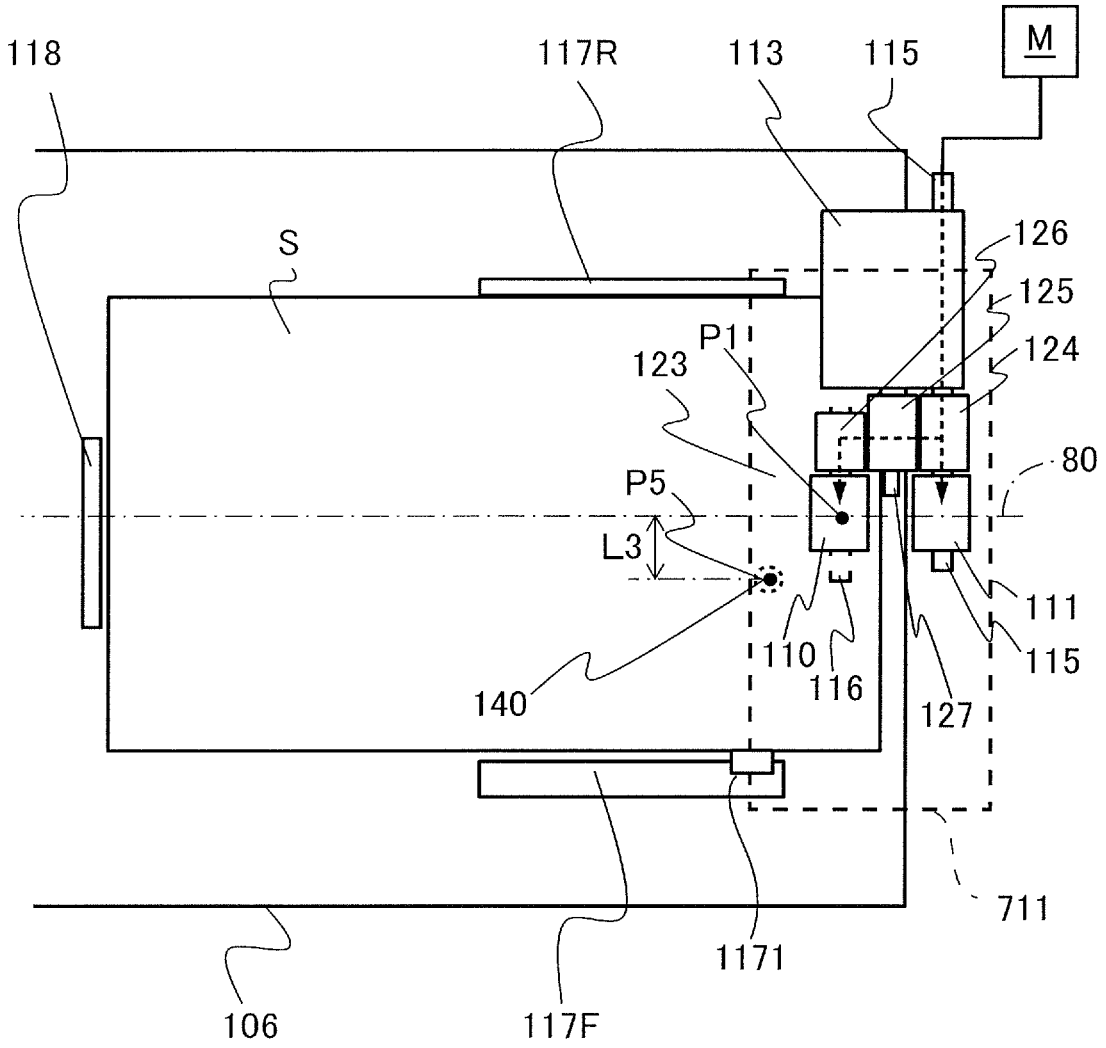
FIG. 14 is a plan view illustrating a sheet feeding apparatus according to a fourth embodiment.
Figure 15:
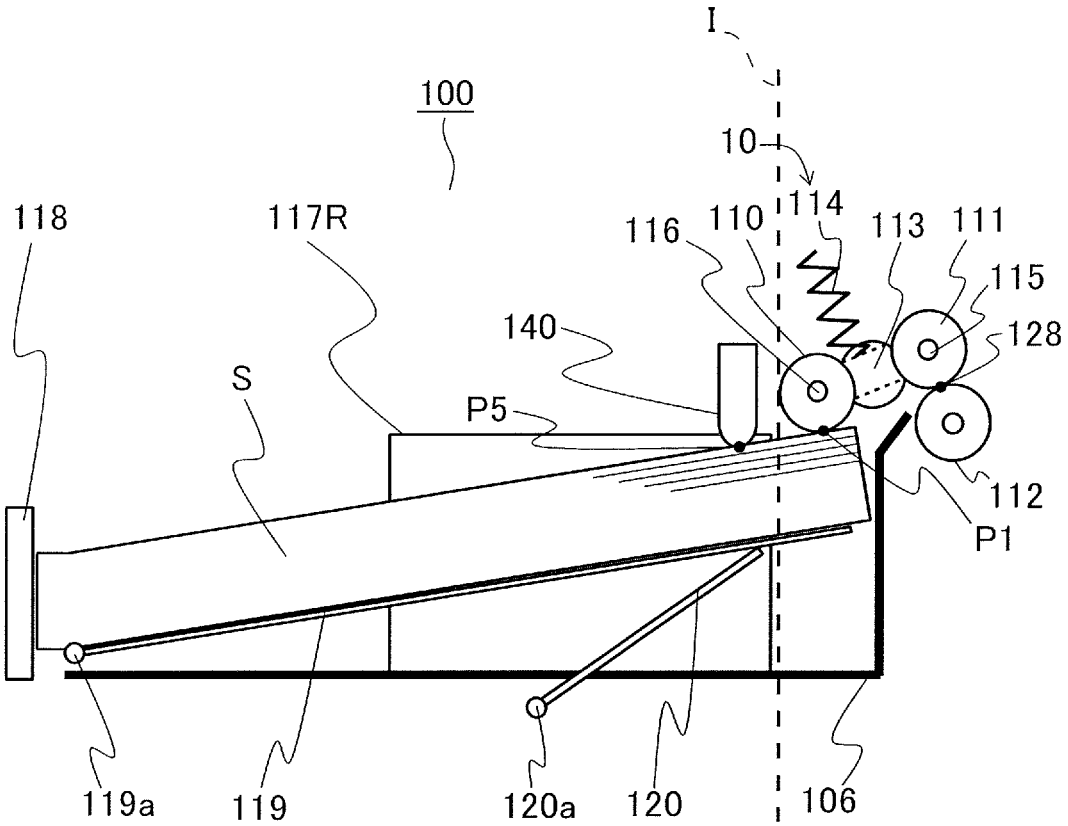
FIG. 15 is a side view illustrating a sheet feeding apparatus according to a fourth embodiment.

FIG. 14 illustrates a configuration in which the friction member 140 is supported by a housing 711 of the printer body 71. The friction member 140 contacts the sheet S at a contact point P5 upstream of the pickup roller 110. More specifically, as illustrated in FIG. 15, the friction member 140 has a downstream end thereof in the sheet conveyance direction positioned upstream than a virtual line I illustrating the upstream end position of the pickup roller 110, similar to the above-described embodiment, and contacts the sheet S at the contact point P5 positioned upstream than the contact point P1 of the pickup roller 110 with the sheet S.

Further, as illustrated in FIG. 14, the friction member 140 is supported via a spring on a housing 711 of the printer body 71, such that it has a high freedom of arrangement, and the contact point P5 is arranged to be displaced for distance L3 toward the front side of the apparatus with respect to the conveyance center line 80. In addition, regarding the pair of opposed side regulating guides 117R and 117F, a pressing portion 1171 that presses the sheet supported on the cassette 106 toward the side regulating guide 117R on the abutment side is arranged downstream of the side regulating guide 117F provided on the side in which the friction member 140 is provided. The pressing portion 1171 is configured to urge a side edge of the sheet supported on the cassette 106 toward the side regulating guide 117R in the sheet width direction by urging force applied from an urging member positioned between the main body portion of the side regulating guide 117R and the pressing portion 1171.

According to this configuration, the sheet supported on the cassette 106 is conveyed while having the side edge of the sheet pressed against the contact surface of the side regulating guide 117R, by applying turning force directed toward the side regulating guide 117R on the sheet at contact point P5 similar to the second embodiment, and also by applying urging force from the pressing portion 1171. In the present embodiment, downstream end positions of the side regulating guides 117R and 117F in the sheet conveyance direction are arranged upstream than the pickup roller 110.

Fifth Embodiment

Next, a fifth embodiment of the present invention will be described. The fifth embodiment applies the obliquely conveying roller according to the first embodiment to a multi-purpose feeding apparatus 60. Therefore, similar configurations as the first embodiment are either not shown in the drawing or denoted with the same reference numbers.

Figure 16:
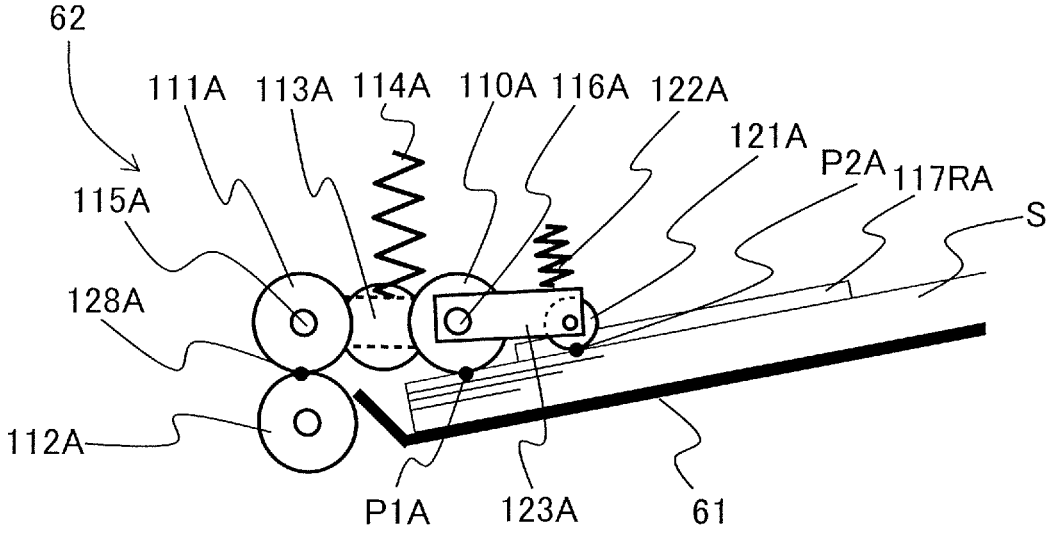
FIG. 16 is a side view illustrating a multi-purpose feeding apparatus according to a fifth embodiment.
Figure 17:
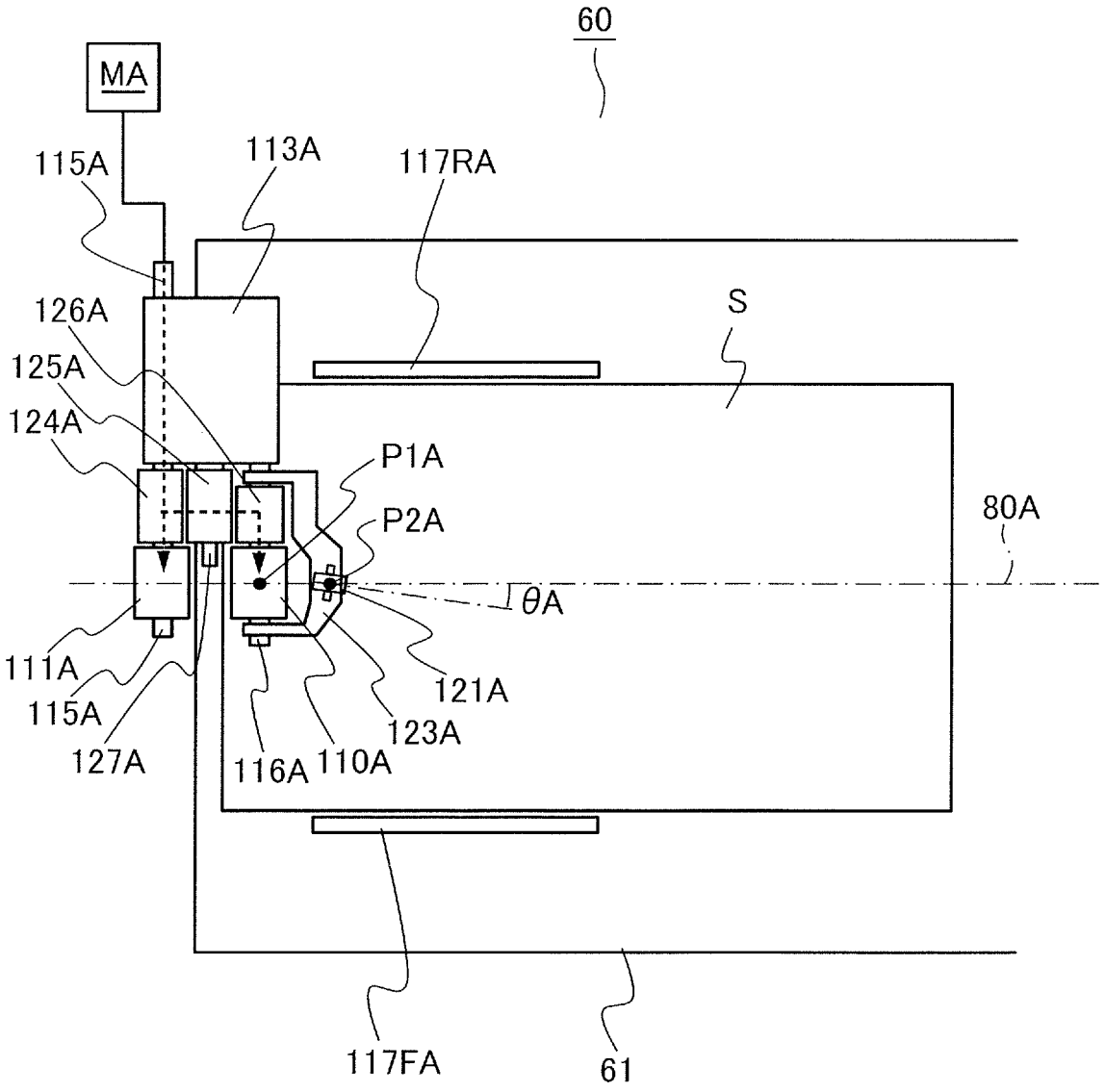
FIG. 17 is a plan view illustrating the multi-purpose feeding apparatus.

As illustrated in FIGS. 16 and 17, the present embodiment has applied the configuration of the sheet feeding unit 10 described in the first embodiment to the multi-purpose feeding apparatus 60 serving as a sheet feeding apparatus. Therefore, in FIGS. 16 and 17, members that exert similar effects as the members described in the first embodiment are denoted with reference numbers having added "A" to the reference numbers illustrated in FIGS. 2B and 3, and descriptions thereof are omitted.

Feeding force is applied to a sheet S supported on a multi-purpose tray 61 serving as a sheet supporting portion from a pickup roller 110A serving as a rotary feeding member, and turning force is applied to the sheets by an obliquely conveying roller 121A. Therefore, the feeding force and the turning force can be set independently.

Figure 18:
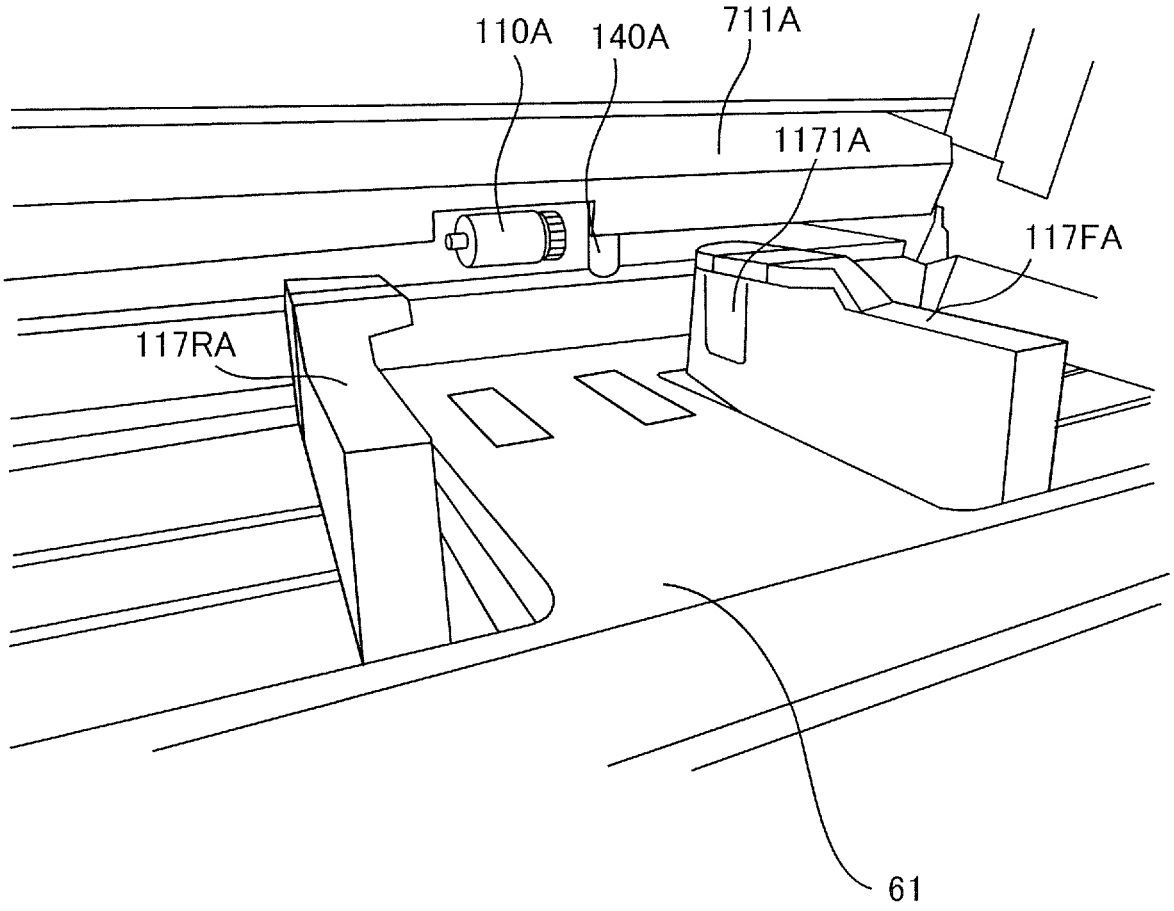
FIG. 18 is a perspective view illustrating the multi-purpose feeding apparatus to which a friction member is applied.

According to the present embodiment, the configuration illustrated in the first embodiment is applied to the multi-purpose feeding apparatus 60, but of course, the configurations illustrated in the second to fourth embodiments can also be applied to the multi-purpose feeding apparatus 60. Further, if the configuration illustrated in the fourth embodiment is applied to the multi-purpose feeding apparatus 60, a configuration illustrated in FIG. 18 is acquired. That is, if the configuration is applied to the multi-purpose feeding apparatus 60, a friction member 140A is supported by a housing 711A constituting the side portion of the printer body 71, and the position thereof is positioned upstream than the upstream side end of a pickup roller 110A in the sheet conveyance direction. Further, regarding the side regulating guides 117FA and 117RA, the side regulating guide 117FA positioned on the side having the friction member 140A is provided with a pressing portion 1171A.

Sixth Embodiment

Next, a sixth embodiment of the present invention will be described. According to the sixth embodiment, one of the two side regulating guides of the fifth embodiment is replaced with a fixed guide. Therefore, similar configurations as the fifth embodiment are either not shown in the drawing or denoted with the same reference numbers.

In the first to fifth embodiments, the side regulating guides on the front and back sides of the apparatus are both configured to be movable in the width direction, and the sheet feeding apparatus adopts a system in which the sheet S is fed by so-called center-referenced-conveyance. However, the present invention is not only applicable to center-referenced-conveyance type sheet feeding apparatuses, but also to side-referenced-conveyance type sheet feeding apparatuses.

Figure 19:
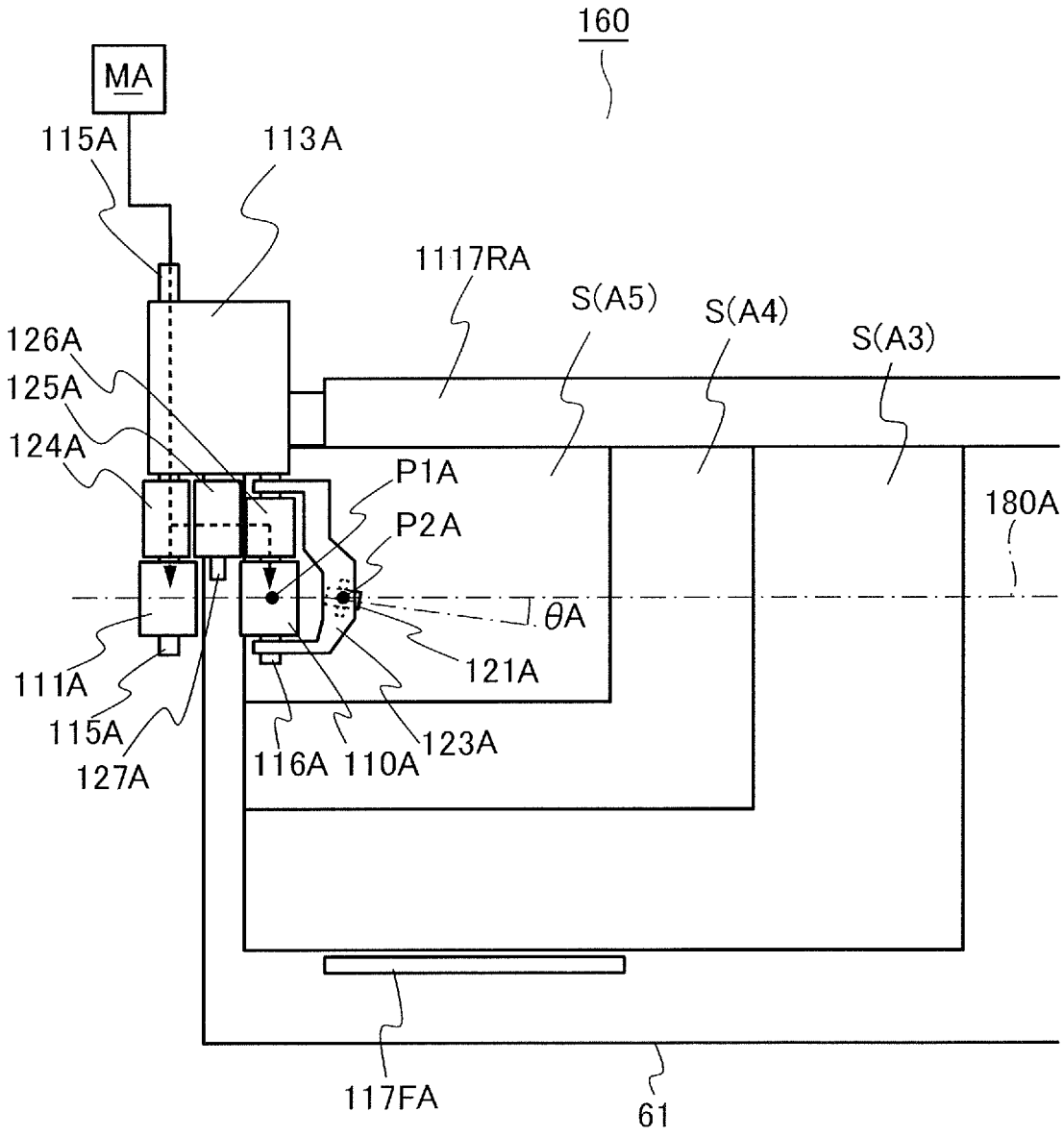
FIG. 19 is a plan view illustrating a multi-purpose feeding apparatus according to a fifth embodiment.

FIG. 19 is a plan view illustrating a side-referenced-conveyance type multi-purpose feeding apparatus 160 according to the present embodiment. The multi-purpose feeding apparatus 160 comprises a fixed guide 1117RA and a side regulating guide 117FA that respectively regulate positions of the edge portions in the width direction of the sheet supported on a multi-purpose tray 61. If a linear line connecting a contact point P1A between the sheet S and a pickup roller 110A and a contact point P2A between the sheet S and an obliquely conveying roller 121A is referred to as a linear line 180A, the linear line 180A is extended substantially parallel with the sheet feeding direction.

A side regulating guide 117FA serving as a fourth guide is provided on a front side in the apparatus than the linear line 180A, and it is supported movably in the width direction with respect to the multi-purpose tray 61. The fixed guide 1117RA is provided on a back side in the drawing than the linear line 180A, and it is fixed to the multi-purpose tray 61. That is, the fixed guide 1117RA serving as a third guide is relatively non-movable with respect to the multi-purpose tray 61. The sheet S supported on the multi-purpose tray 61 receives feeding force from a pickup roller 110A, and also receives turning force from an obliquely conveying roller 121A. In this state, the turning force is applied so as to press the sheet S against the fixed guide 1117RA. That is, the obliquely conveying roller 121A is arranged such that the turning force applied by the obliquely conveying roller 121A presses the sheet S against the fixed guide 1117RA. Since the present embodiment adopts side-referenced-conveyance instead of center-referenced-conveyance, for example, A5, A4 and A3-sized sheets illustrated in FIG. 16 do not have to be arranged symmetrically with respect to the linear line 180A connecting the contact point P1A and the contact point P2A.

In any of the embodiments described above, the members generating turning force, which are the obliquely conveying roller 121, the friction member 130 or 140, and so on, should preferably be arranged upstream in the conveyance direction of the pickup roller 110. By arranging the member generating the turning force upstream in the conveyance direction of the pickup roller 110, shearing force per unit length applied on the sheet being conveyed will become small. The size of the turning force applied on the sheet is proportional to the length of a width direction component of a line segment connecting the position in which a member generating turning force contacts the sheet and a position in which the pickup roller 110 contacts the sheet. Meanwhile, shearing force acting on the sheet per unit length is inversely proportional to the aforementioned length of the line segment. The shearing force acting on the sheet is generated by the sheet being pulled between the member generating turning force and the pickup roller 110. If the value of the shearing force is fixed, the shearing force generated per unit length of the sheet decreases as the aforementioned length of the line segment increases.

Therefore, if the member generating the turning force is arranged upstream of the pickup roller 110 in the conveyance direction, the shearing force acting on the sheet per unit length can be reduced while generating a similar turning force compared to the case where the member generating the turning force is arranged at a position displaced in the width direction of the pickup roller 110.

In all of the aforementioned embodiments, the printer 200 adopting an electrophotographic system has been described, but the present embodiment is not restricted thereto. For example, the present invention can be applied to ink jet-type image forming apparatuses that form an image on a sheet by discharging ink through nozzles. Further, the present invention can be applied to ADFs (Auto Document Feeders) that convey documents automatically. Moreover, the first through sixth embodiments can be combined.

According to the above-described embodiment in which the sheet is turned using the friction member 140 or 140A, the sheet is turned around a contact point of the pickup roller 110 or 110A, but a configuration can also be adopted in which the sheet is turned toward the side regulating guide by the conveying force of the pickup roller 110 or 110A around the contact point of the friction member 140 or 140A.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-083166, filed Apr. 19, 2017 and Japanese Patent Application No. 2018-006422, filed Jan. 18, 2018, which are hereby incorporated by reference wherein in their entirety.

What is claimed is:

1. A sheet feeding apparatus comprising:

a sheet supporting portion configured to support a sheet;

a separation portion configured to feed the sheet supported on the sheet supporting portion while separating from another sheet;

a pickup roller disposed upstream, in a sheet feeding direction, of the separation portion, and configured to contact the sheet supported on the sheet supporting portion, and rotate so as to feed the sheet toward the separation portion;

a regulating portion comprising a contact surface configured to be in contact with an edge portion in a width direction orthogonal to the sheet feeding direction of the sheet supported on the sheet supporting portion, the regulating portion being configured to regulate a position of the edge portion; and an oblique conveying roller arranged upstream of the pickup roller in the sheet feeding direction, and configured to be rotatable around a rotational axis oblique with respect to the width direction and be rotated by the sheet fed by the pickup roller, the oblique conveying roller being configured to contact the sheet supported on the sheet supporting portion upstream in the sheet feeding direction of the pickup roller so that the sheet fed by the pickup roller turns by a force applied from the oblique conveying roller, wherein the oblique conveying roller comprises a contact portion contacting the sheet supported on the sheet supporting portion, the contact portion being positioned more upstream than a downstream end of the contact surface of the regulating portion in the sheet feeding direction;

a rotation shaft configured to rotatably support the pickup roller; and an arm supported on the rotation shaft, wherein the oblique conveying roller is supported rotatably on the arm.

2. The sheet feeding apparatus according to claim 1, wherein the contact portion of the oblique conveying roller is a first contact portion, the pickup roller contacts the sheet supported on the sheet supporting portion at a second contact portion, and a linear line connecting the first and second contact portions is substantially parallel with the sheet feeding direction.

3. The sheet feeding apparatus according to claim 1, wherein an outer diameter of the obliquely conveying roller is smaller than an outer diameter of the pickup roller.

4. The sheet feeding apparatus according to claim 1, further comprising:

a first urging member configured to urge the pickup roller toward the sheet supported on the sheet supporting portion, and a second urging member configured to urge the oblique conveying roller toward the sheet supported on the sheet supporting portion.

5. The sheet feeding apparatus according to claim 1, further comprising:

an apparatus body on which the pickup roller is provided; and a cassette configured to be drawn out from the apparatus body, wherein the sheet supporting portion is supported liftably on the cassette.

6. The sheet feeding apparatus according to claim 1, wherein the sheet supporting portion is a tray on which the sheet is fed manually.

7. The sheet feeding apparatus according to claim 1, wherein the regulating portion comprises first and second guides configured to be interlocked symmetrically with respect to a conveyance center line in the width direction of the sheet supporting portion.

8. The sheet feeding apparatus according to claim 1, wherein the regulating portion comprises a third guide configured relatively non-movably with respect to the sheet supporting portion, and a fourth guide configured relatively movably with respect to the sheet supporting portion, and the sheet onto which force has been applied by the oblique conveying roller is turned so as to be pressed against the third guide.

9. An image forming apparatus comprising:

a sheet supporting portion configured to support a sheet;

a separation portion configured to feed the sheet supported on the sheet supporting portion while separating from another sheet;

a pickup roller disposed upstream, in a sheet feeding direction, of the separation portion, and configured to contact the sheet supported on the sheet supporting portion and rotate so as to feed the sheet toward the separation portion;

a regulating portion comprising a contact surface configured to be in contact with an edge portion in a width direction orthogonal to the sheet feeding direction of the sheet supported on the sheet supporting portion, the regulating portion being configured to regulate a position of the edge portion;

an oblique conveying roller arranged upstream of the pickup roller in the sheet feeding direction, and configured to be rotatable around a rotational axis oblique with respect to the width direction and be rotated by the sheet fed by the pickup roller, the oblique conveying roller being configured to contact the sheet supported on the sheet supporting portion upstream in the sheet feeding direction of the pickup roller so that the sheet fed by the pickup roller turns by a force applied from the oblique conveying roller, wherein the oblique conveying roller comprises a contact portion contacting the sheet supported on the sheet supporting portion, the contact portion being positioned more upstream than a downstream end of the contact surface of the regulating portion in the sheet feeding direction;

a rotation shaft configured to rotatably support the pickup roller;

an arm supported on the rotation shaft; and an image forming unit configured to form an image on the sheet fed by the pickup roller, wherein the oblique conveying roller is supported rotatably on the arm.

* * * * *